US007999639B2

(12) United States Patent
Kodama

(10) Patent No.: US 7,999,639 B2
(45) Date of Patent: Aug. 16, 2011

(54) WAVEGUIDE STRUCTURE COMPRISED OF GROOVES FORMED IN RESIN AND METAL PORTIONS

(75) Inventor: Katsuhisa Kodama, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 193 days.

(21) Appl. No.: 12/392,772

(22) Filed: Feb. 25, 2009

(65) Prior Publication Data

US 2010/0109817 A1 May 6, 2010

(30) Foreign Application Priority Data

Nov. 6, 2008 (JP) ..... 2008-285428

(51) Int. Cl.
*H01P 3/12* (2006.01)

(52) U.S. Cl. ..... 333/239; 333/1

(58) Field of Classification Search ..... 333/239, 333/248, 137, 1
See application file for complete search history.

(56) References Cited

U.S. PATENT DOCUMENTS

| | | | | |
|---|---|---|---|---|
| 3,157,847 | A * | 11/1964 | Williams | 333/239 |
| 4,020,875 | A * | 5/1977 | Akiba | 138/128 |
| 2003/0137371 | A1* | 7/2003 | Saitoh et al. | 333/239 |
| 2004/0104793 | A1* | 6/2004 | Tamura et al. | 333/239 |

FOREIGN PATENT DOCUMENTS

| | | |
|---|---|---|
| JP | 2002076716 | 3/2002 |
| JP | 2003087009 | 3/2003 |
| JP | 2004-048486 A | 2/2004 |
| JP | 2005045341 | 2/2005 |

OTHER PUBLICATIONS

Japanese Office Action dated Oct. 19, 2010.

* cited by examiner

*Primary Examiner* — Benny Lee
(74) *Attorney, Agent, or Firm* — Sughrue Mion, PLLC

(57) ABSTRACT

A waveguide structure including a first member, made of metal, in a surface portion of which a first groove having a linear shape is formed; and a second member, made of resin, in a surface portion of which a second groove having a linear shape is formed and to the surface of which metal plating is applied. The first member and the second member are arranged in such a way that the first groove and the second groove face each other so that a waveguide tube is configured. The first member in the surface portion of which the first groove is formed and the second member in the surface portion of which the second groove is formed are held in such a way that a gap exists between the respective surfaces thereof.

25 Claims, 7 Drawing Sheets

WAVEGUIDE STRUCTURE COMPRISED OF GROOVES FORMED IN RESIN AND METAL PORTIONS

BACKGROUND OF THE INVENTION

1. Field of the Invention

The present invention relates to a waveguide-tube structure (waveguide structure) suitable for transmission of a microwave or a millimeter wave.

2. Description of the Related Art

FIG. 10 is a cross-sectional view illustrating an example of prior art waveguide tube (waveguide structure).

For example, the waveguide tube is configured in such a way that two approximately rectangular-parallelepiped conductive members 10 and 20 are laminated, and grooves 10*a* and 20*a* formed in the respective surfaces of the conductive members 10 and 20 are made to face each other; as a result, a hollow waveguide tube 30 having an approximately rectangular cross section.

In addition, the waveguide tube 30 is formed in a linear shape, and the direction of the tube axis thereof is perpendicular to the paper plane of FIG. 10.

The plane on which the conductive members 10 and 20 face each other is the division plane of the waveguide tube 30.

The hollow waveguide tube 30, of this kind, that is divided by a division plane and whose cross section has a rectangular shape can be manufactured through die-casting, whereby the production costs can be suppressed to be relatively low.

Methods of dividing the waveguide tube 30 include a method of dividing a waveguide tube by a division plane parallel to the transverse side of a cross section of the waveguide tube and a method of dividing a waveguide tube by a division plane parallel to the longitudinal side of a cross section of the waveguide tube.

In the case where a waveguide tube is formed through a division structure, deterioration of the transmission performance can be suppressed more effectively by utilizing the method of dividing the waveguide tube by a division plane parallel to the transverse side of a cross section of the waveguide tube, as illustrated in FIG. 10.

However, in the case where the longitudinal side of a waveguide tube is divided by a division plane parallel to the transverse side of a rectangular cross section of the waveguide tube, the groove depth is longer than the groove width, whereby the manufacturing through molding is liable to become difficult.

In the case of die-casting or the like, in general, the longer than the groove width the groove depth is, the more difficult it is that the melted metal flows into the front end of the wall that forms the groove; therefore, there has been a problem that the molding accuracy is deteriorated.

Moreover, there has been a problem that, the longer the groove depth as compared to the groove width, the shorter the lifetime of a die that is utilized for die-casting. Also, the production costs eventually become expensive.

In Japanese Patent Application Laid-Open No. 2004-48486 (Patent Document 1), there is disclosed "a waveguide tube characterized by having a structure in which two tub-shaped divided members obtained through division by an H-plane or an E-plane are bonded to each other, and characterized in that the cross section thereof perpendicular to the longitudinal direction thereof has a hexagonal shape".

The structure of the waveguide tube disclosed in Patent Document 1 is similar to the structure of the waveguide tube illustrated in FIG. 10 "in terms of the fact that a hollow waveguide tube is formed of two divided members (i.e., two tube-shaped divided members)".

As measures for the foregoing problems in the known waveguide tube, there is conceivable a method in which a waveguide tube is formed by applying metal plating to a resin member or the like that has a superior moldability.

However, in some cases, due to a structural factor, the need for heat radiation, or the like, resin cannot be utilized for both of the conductive members 10 and 20 that configure the waveguide tube 30; thus, the waveguide tube 30 cannot help being formed by utilizing metal only for one of the conductive members 10 and 20 and combining the metal member and the resin member.

In this case, due to contact friction caused by the linear-expansion difference between the members, separation of metal plating occurs in a junction surface produced by laminating the metal member 10 and the resin member 20 to which metal plating is applied.

When separation of metal plating occurs, separation powder of the metal plating becomes floating dirt in the waveguide tube, thereby deteriorating the transmission performance, or a separation portion produced by friction causes a separation area to expand; thus, there eventually occurs a problem, such as the occurrence of wall-face separation of the waveguide tube, which considerably deteriorates the function of the waveguide tube.

Moreover, there occurs a problem that, due to the linear-expansion difference between the laminated members (i.e., the laminated metal member 10 and resin member 20), "the relative position between the laminated members is displaced".

It goes without saying that, when the relative position between the laminated members (i.e., the laminated metal member 10 and resin member 20) is displaced, the transmission performance (propagation performance) is affected.

Here, the reason why separation of metal plating occurs in the known waveguide tube will be explained in detail.

As illustrated in FIG. 10, the hollow waveguide tube 30 is configured by laminating the members 10 and 20 in such a way that the linear grooves 10*a* and 20*a* that are formed in the respective surfaces of the members 10 and 20 face each other.

With the configuration of the waveguide tube illustrated in FIG. 10, in the case where the waveguide tube 30 is formed by laminating the members 10 and 20 that are made of different materials, due to the linear-expansion difference between the members, contact friction occurs at a position where the members make contact with each other.

With such a waveguide tube configuration as illustrated in FIG. 10, because the metal member 10 and the resin member 20 to the surface of which metal plating is applied directly make contact with each other, change in the temperature under the environment of actual use causes contact friction produced by the linear-expansion difference between the members to occur at a position where the members make contact with each other; therefore, there exists a problem that the metal plating applied to the surface of the resin member 20 is separated and separation powder is produced.

In FIG. 10, the member 10 is formed of a metal material such as SUS (stainless steel) or AL (aluminum); the member 20 is formed of a material obtained by applying plating of metal such as nickel to the surface of a resin material such as ABS (acrylonitrile butadiene styrene) or PEI (polyetherimide).

As described above, in the waveguide tube 30 in which the members 10 and 20 that are made of different materials are laminated, due to the difference between the linear-expansion coefficients of the members 10 and 20, the expansion/contraction amounts of the members differ from each other, when the environmental temperature changes.

For example, in the case where the member 10 is formed of SUS having a linear-expansion coefficient of $1.7\times10^{-5}$, and the member 20 is formed of ABS having a linear-expansion coefficient of $8.5\times10^{-5}$, 50-degree change in the temperature causes the expansion/contraction amounts per 50-millimeter basic line to differ by 0.17 mm from each other, whereby the difference in the deformation amount causes friction.

The contact friction causes separation of metal plating in a known waveguide tube.

In the case where, as illustrated in FIG. 10, the waveguide tube is divided at the middle of the longitudinal side thereof (i.e., the depths of the grooves 10*a* and 20*a* are equal to each other), the groove depths are longer than the respective groove widths, whereby the molding of the metal members through die-casting may become difficult.

Accordingly, the yield rate of the product is deteriorated, and the lifetime of the die is shortened.

In order to cope with this problem, it is desired to make the depth of the groove formed in the surface portion of the metal member shorter than the depth of the groove formed in the surface portion of the resin member.

SUMMARY OF THE INVENTION

The present invention has been implemented in order to solve the foregoing problems; an objective thereof is to provide a waveguide structure in which a hollow waveguide tube whose cross section has an approximately rectangular shape is formed by laminating two conductive members in such a way that respective grooves formed in the surface portions of the conductive members face each other, and contact friction can be prevented from causing separation of metal plating at the junction portion between the two conductive members so that deterioration in the quality (deterioration in the transmission performance) can be suppressed.

Moreover, another objective thereof is to provide a waveguide structure in which, through die-casting, grooves can be formed with a high yield rate in the surface portions of metal members so that shortening of the lifetime of the die can be suppressed.

Furthermore, another objective thereof is to provide a waveguide structure in which the positional relationship between two conductive members can be prevented from being displaced by the linear-expansion difference between the conductive members.

A waveguide structure according to the present invention includes a first member, made of metal, in a surface portion of which a first groove having a linear shape is formed; and a second member, made of resin, in a surface portion of which a second groove having a linear shape is formed and to the surface of which metal plating is applied. The first member and the second member are arranged in such a way that the first groove and the second groove face each other so that a waveguide as a waveguide tube is configured, and the first member in the surface portion of which the first groove is formed and the second member in the surface portion of which the second groove is formed are held in such a way that a gap exists between the respective surfaces thereof.

Therefore, according to the present invention, by combining the first member that is made of metal and has a high heat radiation performance and the second member that is obtained by applying metal plating to a resin member having a high moldability, the heat radiation performance is improved in comparison with the case where both the first and second members are made of resin.

Moreover, because the first and second members that face each other are held in such a way that a predetermined gap exists between the respective surfaces thereof, contact friction produced between the first and second members can be prevented from causing separation of the metal plating.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
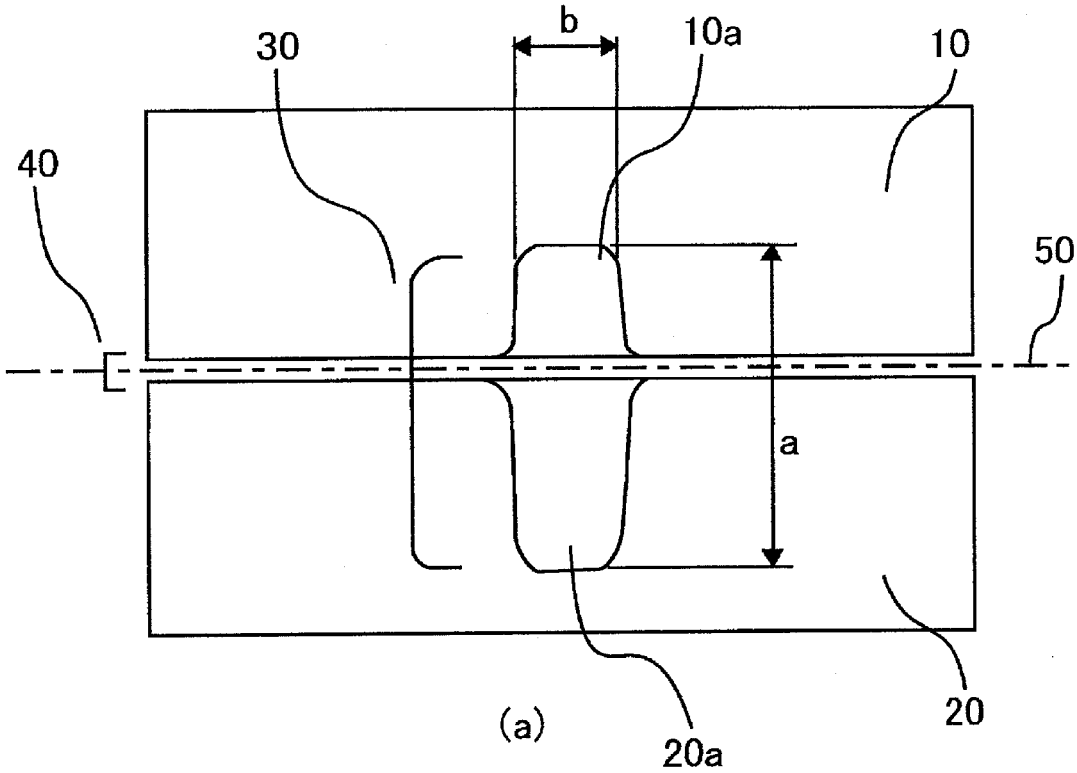
FIG. 1 is a set of views for explaining a waveguide structure (waveguide) according to Embodiment 1, where FIG. 1(*a*) is a cross-sectional view taken along a plane perpendicular to the tube axis and FIG. 1(*b*) is a diagram illustrating the stereoscopic structure of a waveguide structure.
Figure 1:
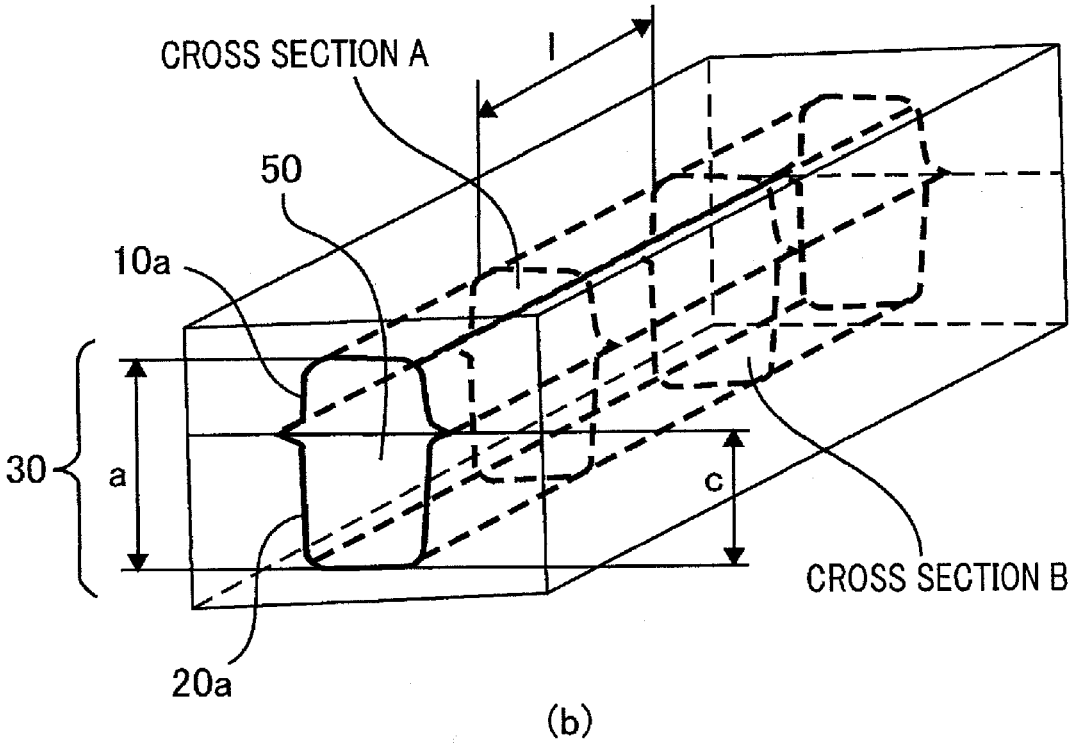

Embodiments of the present invention will be explained below with reference to the accompanying drawings.

In addition, the same reference characters in the figures denote the same or equivalent constituent elements and may not be described in detail for all drawing figures in which they appear.

Embodiment 1

FIG. 1 is a set of views for explaining a waveguide structure (waveguide tube) according to Embodiment 1; FIG. 1(*a*) is a cross-sectional view taken along a plane perpendicular to the tube axis; FIG. 1(*b*) is a diagram illustrating the stereoscopic structure of a waveguide structure.

Figure 10:
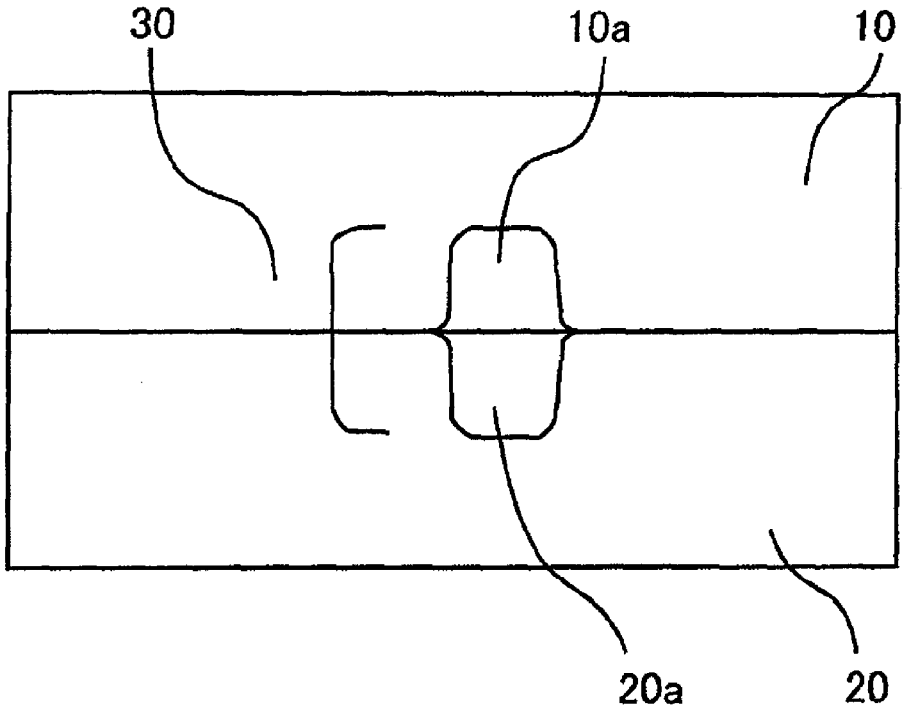
PRIOR ART FIG. 10
FIG. 10 is a view illustrating a prior art waveguide tube (waveguide structure).

In Embodiment 1, as is the case with the conventional waveguide tube illustrated in FIG. 10, a linear groove 10*a* (referred to also as a first groove, hereinafter) is formed in the surface portion of a metal member 10 (FIG. 1(*a*)) having an electric conductivity; a linear groove 20*a* (referred to also as a second groove, hereinafter) is formed in the surface portion of a resin member 20 (FIG. 1(*b*)) to which metal plating is applied and that has an electric conductivity.

A hollow waveguide tube 30, whose cross section parallel to a plane perpendicular to the tube axis has an approximately rectangular shape, is formed by making the linear grooves 10*a* and 20*a* that are formed in the respective surfaces of the metal member 10 and the resin member 20 face each other.

Reference numeral 50 denotes a plane on which the metal member 10 and the resin member 20 face each other and that is a division plane of the hollow waveguide tube 30.

In addition, the tube axis of the waveguide tube 30 is perpendicular to the paper plane of FIG. 1(*a*).

The hollow waveguide tube 30, of this kind, that is divided by the division plane 50 and whose cross section has a rectangular shape can be manufactured through die-casting, whereby the production costs can be suppressed to be relatively low.

In a waveguide structure (waveguide tube) according to Embodiment 1, in order to solve the problem "that, due to the linear-expansion difference between the metal member 10 and the resin member 20, contact friction occurs at the contact portion; the metal plating applied to the surface of the resin member 20 is separated; and produced separation powder of the metal plating deteriorates the propagation performance (transmission performance) of the waveguide tube", a gap 40 is intentionally provided at the division portion of the waveguide tube, as illustrated in FIG. 1(*a*).

Figure 2:
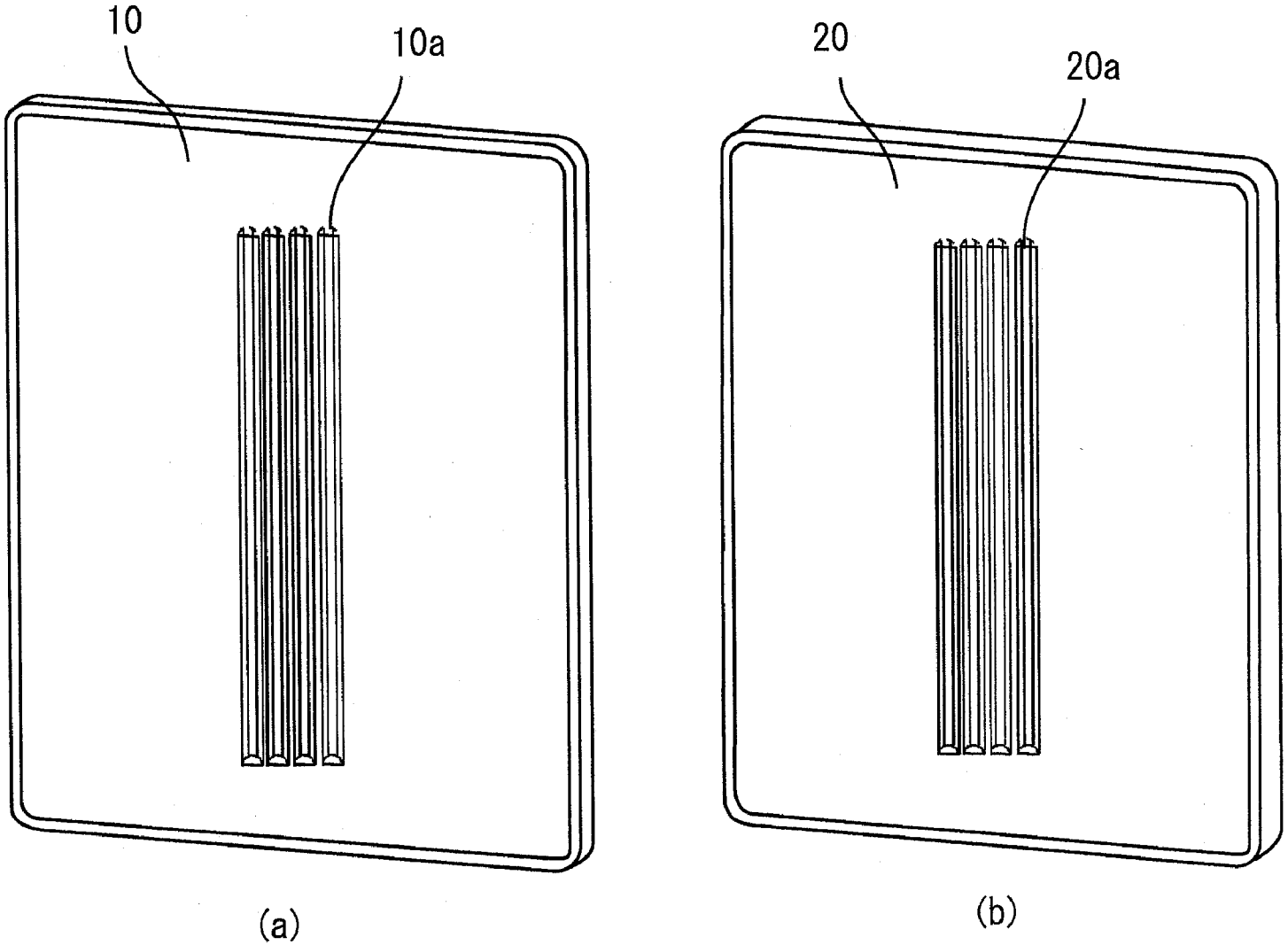
FIG. 2 is a set of perspective views for explaining a waveguide structure according to Embodiment 1, where FIG. 2(*a*) illustrates a plurality of grooves 10*a* formed in the surface portion of the metal member 10 and FIG. 2(*b*) illustrates a plurality of grooves 20*a* formed in the surface portion of the resin member 20.

FIG. 2 is a set of perspective views for explaining a waveguide structure according to the present invention; FIG. 2(*a*) illustrates a plurality of grooves 10*a* formed in the surface portion of the metal member 10; FIG. 2(*b*) illustrates a plurality of grooves 20*a* formed in the surface portion of the resin member 20.

In a waveguide structure according to Embodiment 1, a plurality of hollow waveguide tubes 30, formed by arranging the plurality (four, in FIG. 2(*a*) of grooves 10*a* and the plurality (four, in FIG. 2(*b*) of grooves 20*a* in such a way that they face respective corresponding grooves, is disposed in such a way that they are adjacent to one another.

FIG. 1 is a set of views illustrating the cross section of one of the plurality of waveguide tubes and the stereoscopic structure of the waveguide structure.

A waveguide structure (i.e., waveguide tube) according to Embodiment 1 will be further explained in detail with reference to FIGS. 1(*a*) and 1(*b*).

In FIG. 1, the members 10 and 20 are conductive members that are laminated so as to form a waveguide.

In addition, the member 10 is a metal conductive member (referred to also as a first member, hereinafter); the member 20 is a resin conductive member (referred to also as a second member, hereinafter) to the surface of which metal plating is applied.

In Embodiment 1, the hollow waveguide tube 30 is configured by laminating the first and second members 10 and 20 in such a way that the linear grooves 10*a* and 20*a* that are formed in the respective surfaces of the first members 10 and the second member 20 face each other.

Reference numeral 40 denotes a gap intentionally provided when the first and second members 10 and 20 are laminated as depicted in FIG. 1(*a*); reference numeral 50 is a division plane of the waveguide tube 30 that is divided by the gap 40.

In FIG. 1(*a*), the second member 20 in which the groove 20*a* is provided is formed of a resin or the like that has a high moldability, and metal plating is applied to the surface thereof.

The groove 10*a* is formed in the surface portion of the metal-made first member 10.

The waveguide tube 30 that is illustrated in FIGS. 1(*a*) and 1(*b*) and whose cross section has an approximately rectangular shape is divided by the division plane 50 parallel to the transverse side of the rectangular cross section.

The waveguide tube 30 is formed in such a way that an electric wave having a polarization plane parallel to the width direction of the grooves 10*a* and 20*a* propagates in a direction perpendicular to the first and second members 10 and 20.

The inner-tube wavelength of an electric wave that propagates through the waveguide tube 30 is determined by the sum of the overall depth of the grooves 10*a* and 20*a*, which is the longitudinal (the length thereof is designated by "a") side of the cross section of the waveguide tube, and the gap length of the intentionally provided gap 40.

In addition, in FIG. 1(*a*), reference character "b" denotes the width of the groove 10*a* or 20*a*.

There will be explained the principle according to which a desired waveguide-tube performance can be obtained even in the case where the gap 40 exists between the groove 10*a* and the groove 20*a*.

Figure 3:
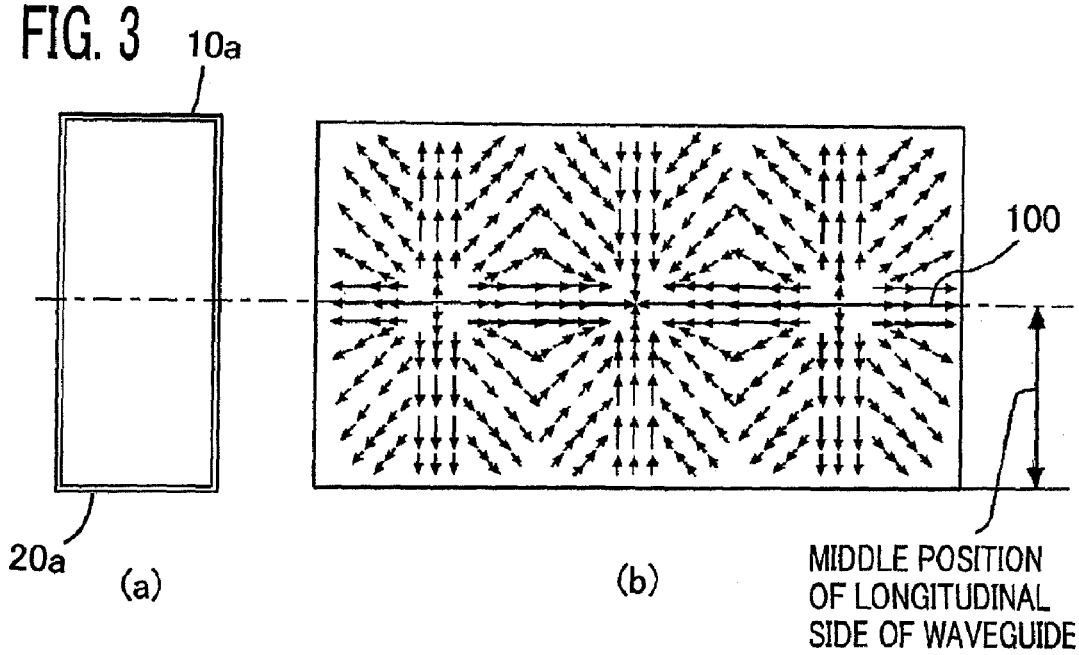
FIG. 3 is a set of charts representing a distribution of current vectors on the sidewall (wide wall face) of a waveguide tube, where FIG. 3(*a*) illustrates the distribution in the cross sectional view of the waveguide tube and FIG. 3(*b*) illustrates the distribution in the sidewall (wide wall face) of the waveguide.

FIG. 3 is a set of charts representing a distribution of current vectors on the sidewall (wide wall face) of a waveguide tube defined by grooves 10*a* and 10*b*; FIG. 3(*a*) illustrates the cross sectional of the waveguide tube; FIG. 3(*b*) illustrates the sidewall (wide wall face) of the waveguide.

In FIG. 3(*b*), reference numeral 100 denotes a current vector on the sidewall (wide wall face) of the waveguide tube.

As illustrated in FIGS. 3(*a*) and 3(*b*), all the vectors of electric currents that flow in the vicinity of the middle of the longitudinal side of the cross section of the waveguide tube are distributed in parallel with the tube axis of the waveguide tube, and no current vectors perpendicular to the tube axis are distributed as depicted in FIG. 3(*b*).

Accordingly, in the case where the waveguide tube is divided by a plane that passes through the middle point of the longitudinal side having a length of "a", the division does not split the flow of the currents that flow on the sidewall.

In addition, because the distribution of current vectors parallel to the tube axis have some width in the longitudinal direction of the waveguide tube, the gap amount caused by the division can be allowed to some extent.

Next, there will be explained the result of a quantitative analysis on the effect of the gap 40 that is intentionally provided.

Figure 4:
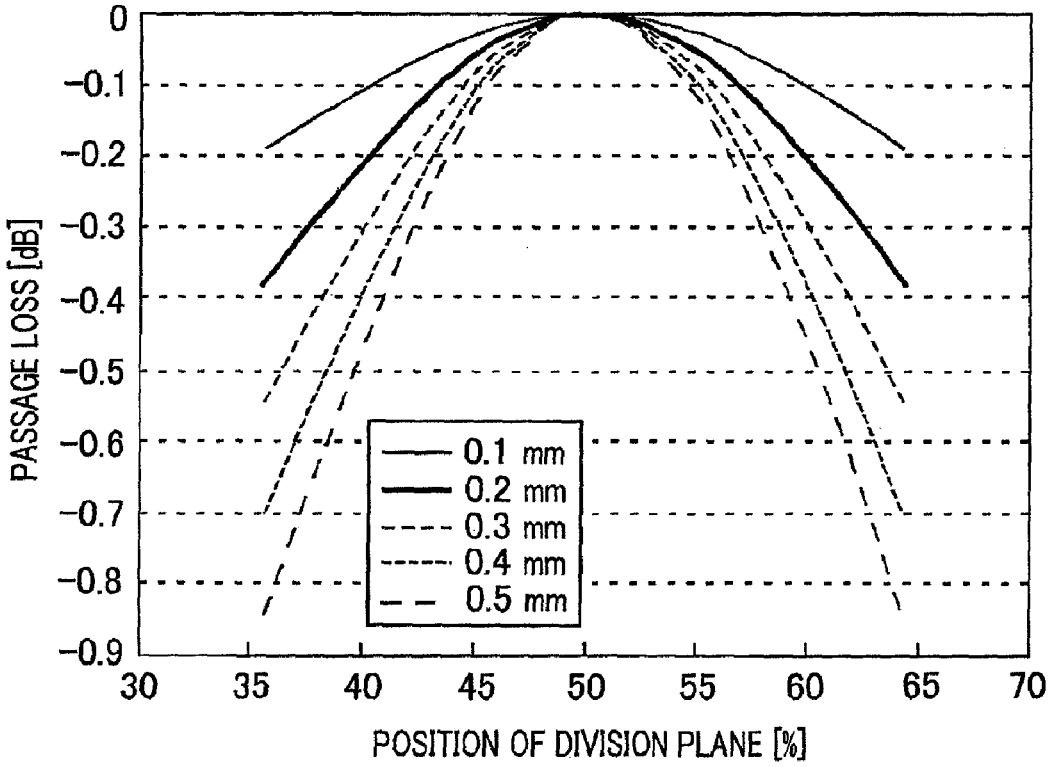
FIG. 4 is a graph representing the result of a passage-loss analysis for a waveguide tube.

FIG. 4 represents the result of an analysis on the relationship between the position of the "division plane" and the "passage loss in the waveguide tube" caused by the gap width.

Here, there was performed the analysis on the passage loss caused throughout the waveguide tube 30, from the cross section at one end to the cross section at the other end thereof.

The subject portion to be analyzed has a shape obtained by elongating by 6 mm in the tube axis the cross section of the waveguide tube 30 including the gap 40 that is intentionally provided.

In other words, in FIG. 1(*b*), the subject portion to be analyzed is elongated by 6 mm (the distance "1" between the cross section A and the cross section B is 6 mm).

As the analysis conditions, the propagation frequency, the transverse-side length "b" of the waveguide tube 30, and the longitudinal-side length "a" of the waveguide 30 were fixed to 76.5 Hz, 1.27 mm, and 3.5 mm, respectively, and the position and the width of the intentionally provided gap 40 were varied.

In FIG. 4, the abscissa denotes the position, represented in the ratio [%], of the division plane 50 with respect to the longitudinal-side length "a" of the waveguide tube (i.e., a distance "c" between the lower transverse side of the waveguide tube 30 and the division plane 50 as depicted in FIG. 1(*b*). In other words, the position [%] of the division plane as the abscissa of FIG. 4 is the ratio "c/a" (as for "a" and "c", refer to FIG. 1(*b*)).

The ordinate of FIG. 4 denotes the passage loss [dB] in the waveguide tube 30.

FIG. 4 represents the results of the analysis in the case where the gap 40 is 0.1 mm, 0.2 mm, 0.3 mm, 0.4 mm, and 0.5 mm.

As represented in FIG. 4, when the analysis was performed, the position of the division plane 50 is varied from 35% to 65%, and the gap 40 is varied from 0.1 mm to 0.5 mm (the division plane 50 passes through the center of the gap 40).

As can be seen from FIG. 4, in the case where the position of the division plane 50 is approximately 50% with respect to the longitudinal side of the waveguide tube, the passage loss is small even in the case where the gap 40 is 0.5 mm. In addition, the division plane with which the passage loss due to the gap becomes small is referred to as an ideal division plane.

However, only in the case where the cross-sectional shapes of the groove 10*a* and the groove 20*a* that face each other are symmetric with each other, the position of the ideal division plane becomes 50% with respect to the longitudinal side of the waveguide tube.

In the case where the foregoing cross-sectional shapes of the waveguide tube are not symmetric with each other in the depth direction thereof, the ideal division plane is displaced from the position of 50% with respect to the longitudinal side of the waveguide tube (i.e., the center position of the longitudinal side of the waveguide tube); therefore, it is required to set an offset for the position of the division plane of the waveguide tube.

In the case where the respective electric conductivities of the electric conductors that form the grooves 10*a* and 20*a* are different from each other, the ideal division plane is displaced even in the case where the shapes of the grooves are symmetric with each other.

In Embodiment 1, as illustrated in FIG. 1(*a*), the shapes of the grooves 10*a* and 20*a* that face each other were intentionally made asymmetric with each other; the conductivities thereof were made to be different from each other; and the ideal division plane was displaced from the position of 50% with respect to the longitudinal side of the waveguide tube.

As in Embodiment 1, by making the shapes of the grooves asymmetric with each other with respect to the division plane and displacing the ideal division plane, "the groove 10*a* whose depth is shorter than the width thereof" can be formed (e.g., the groove 10*a* whose depth is approximately equal to the width); the shape of the groove 10*a* is realized in consideration of the lifetime of the die for die-casting.

The shape of the groove 20*a*, which is the other groove included in the waveguide tube is determined in consideration of resin molding and milling; the groove depth thereof is longer than the groove width.

As described above, a waveguide structure according to Embodiment 1 is provided with a first member 10, made of metal, in the surface portion of which a first groove 10*a* having a linear shape is formed; and a second member 20, made of resin, in the surface portion of which a second groove 20*a* having a linear shape is formed and to the surface of which metal plating is applied. In the waveguide structure, the first member 10 and the second member 20 are arranged in such a way that the first groove 10*a* and the second groove 20*a* face each other so that a waveguide as a waveguide tube is configured; and the first member 10 in the surface portion of which the first groove 10*a* is formed and the second member 20 in the surface portion of which the second groove 20*a* is formed are held in such a way that the gap 40 exists between the respective surfaces thereof.

Therefore, according to Embodiment 1, by combining the first member that is made of metal and has a high heat radiation performance and the second member that is obtained by applying metal plating to a resin member having a high moldability, the heat radiation performance is improved in comparison with the case where both the first and second members are made of resin.

Moreover, because the first and second members that face each other are held in such a way that a predetermined gap exists between the respective surfaces thereof, contact friction produced between the first and second members can be prevented from causing separation of the metal plating.

Additionally, the depth of the first groove 10*a* in a waveguide structure according to Embodiment 1 is shallower than the depth of the second groove 20*a*.

Accordingly, in the formation, through die-casting, of the first groove 10*a* in the surface portion of the first member made of metal, the yield rate is raised and the shortening of the lifetime of the die is suppressed; thus, inexpensive waveguide tubes can be manufactured.

Embodiment 2

Figure 5:
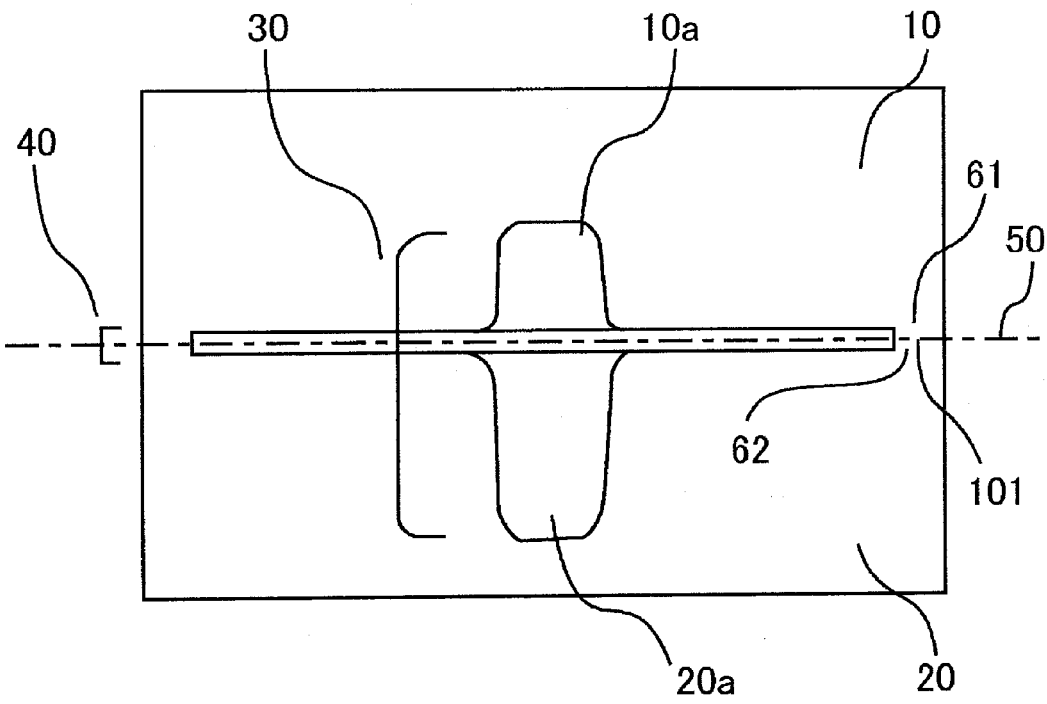
FIG. 5 is a view for explaining an example of waveguide structure according to Embodiment 2.
Figure 6:
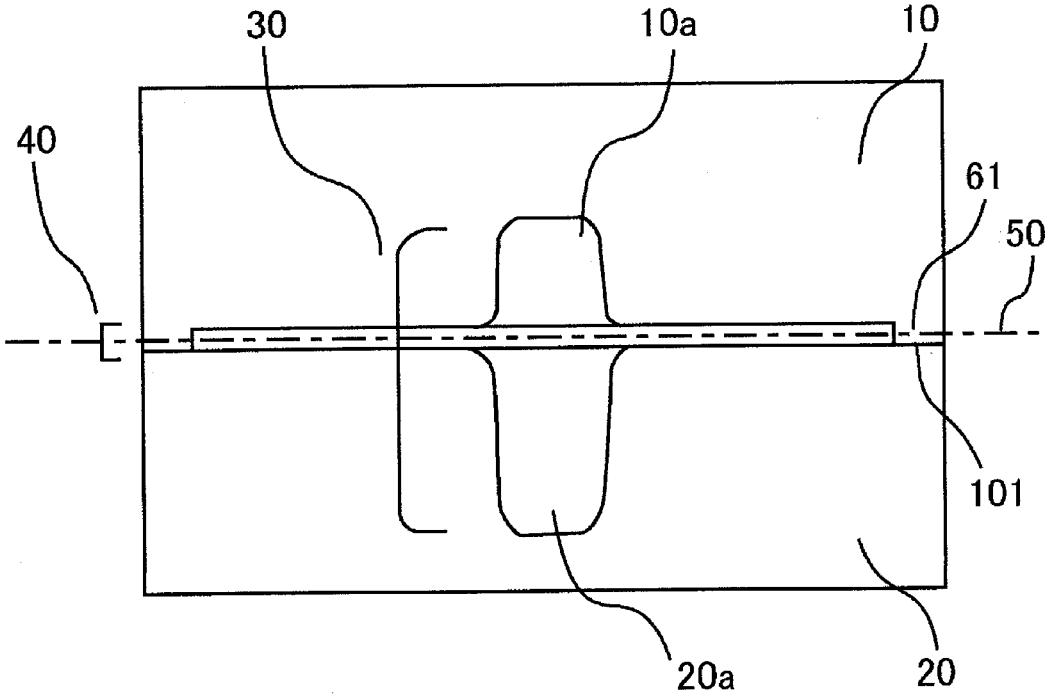
FIG. 6 is a view for explaining an example of waveguide structure according to Embodiment 2.
Figure 7:
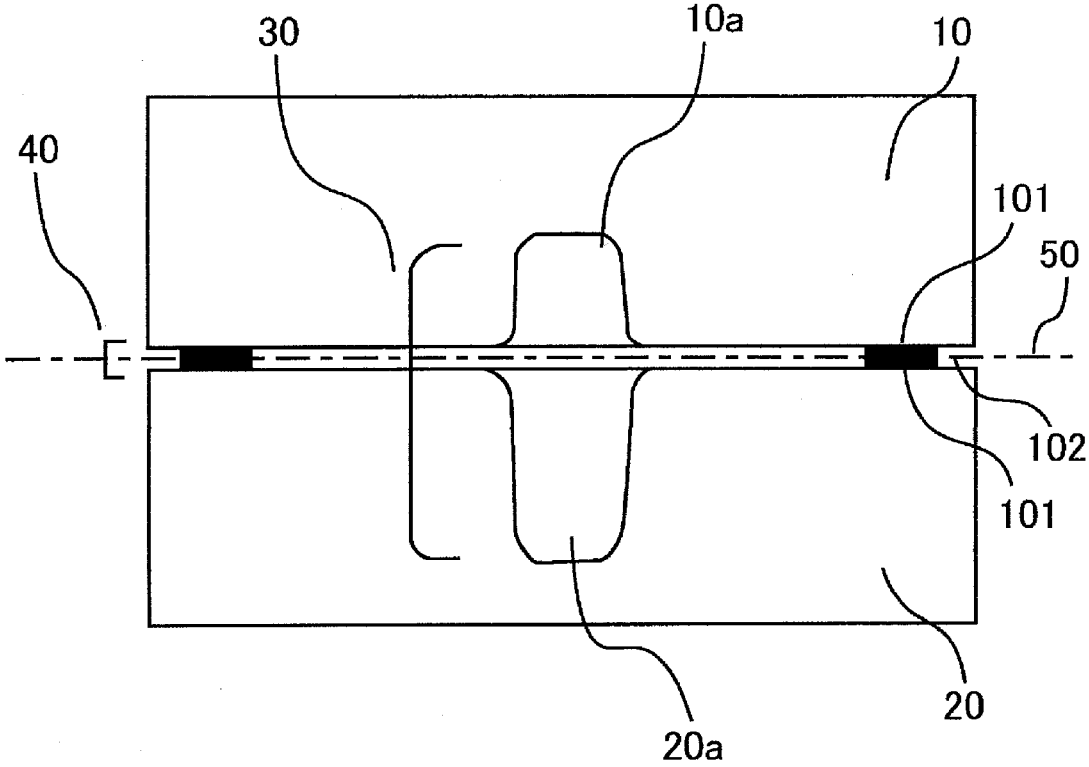
FIG. 7 is a view for explaining an example of waveguide structure according to Embodiment 2.

FIGS. 5 to 7 are views for explaining distinguishing structures of a waveguide structure according to Embodiment 2; in each of FIGS. 5 to 7, there is illustrated a method of fixing first and second members 10 and 20 at a division plane 50 in such a way that a gap of a predetermined length exists between a first groove 10*a* formed in the surface portion of the first member 10 and a second groove 20*a* formed in the surface portion of the second member 20.

For example, as illustrated in FIG. 5 or FIG. 6, at respective positions that are spaced sufficiently apart from the first groove 10*a* and the second groove 20*a* that configure a waveguide tube 30, there are provided protrusion portions on which the first and second members 10 and 20 make contact with each other.

As far as the method of providing the protrusion portions is concerned, as illustrated in FIG. 5, there may be provided protrusions 61 and 62 that protrude from the first and second members 10 and 20, respectively, or, as illustrated in FIG. 6, there may be provided protrusions only in one of the first and second members 10 and 20. In addition, FIG. 6 illustrates a case where the protrusions 61 are provided only in the first member 10.

In FIG. 5, reference numeral 101 denotes a contact surface on which the protrusions 61 and 62 make contact with each other.

In FIG. 6, reference numeral 101 denotes a contact surface on which the protrusion 61 provided only in the first member 10 and the second member 20 make contact with each other.

The height of the protrusion illustrated in each of FIGS. 5 and 6 should be set to be in inverse proportion to the distance between the division plane of a waveguide tube to be produced and the ideal division plane thereof.

The length of a gap 40 is determined by the height of the protrusion portion.

As another method of fixing the first and second grooves 10*a* and 20*a* with a predetermined gap length maintained, for example, there may be a method in which, by inserting spacers 102 (illustrated as black portions in FIG. 7) between the first and second members 10 and 20, the first and second grooves 10*a* and 20*a* are held with a predetermined gap length maintained.

In FIG. 7, reference numeral 101 denotes a contact surface on which the spacer 102 makes contact with the first member 10 or the second member 20.

The length of a gap 40 is determined only by the thickness of the spacer 102.

In each of the methods illustrated in FIGS. 5 to 7, no metal plating is applied to the portion, of the second member 20, on which the second member 20 makes contact with the first member 10 by the intermediary of the protrusion portion or with the spacer 102.

In such a way as described above, contact friction produced between the first and second members 10 and 20 is prevented from causing separation of the plating on the second member 20.

As described above, in a waveguide structure according to Embodiment 2, the gap 40 is formed of protrusions provided in at least one of the first and second members 10 and 20.

Therefore, because the first and second members can be fixed in such a way that a predetermined gap length (i.e., gap amount determined only by the height of the protrusion portion) exists between the respective surfaces thereof, contact friction produced between the first and second members can be prevented from causing separation of the metal plating applied to the surface of the second member.

Moreover, in a waveguide structure according to Embodiment 2, no metal plating is applied to the portion, of the second member 20, on which the protrusion portion and the second member 20 make contact with each other.

Accordingly, contact friction produced between the protrusion portion and the metal plating applied to the surface of the second member can be eliminated, whereby separation of the metal plating can be prevented.

Still moreover, in a waveguide structure according to Embodiment 2, the gap 40 is formed by means of the spacer 102 inserted between the first and second members 10 and 20, and no metal plating is applied to the portion, of the second member 20, on which the second member and the spacer 102 make contact with each other.

Accordingly, contact friction produced between the second member and the spacer can be prevented from causing separation of the metal plating.

Embodiment 3

Figure 8:
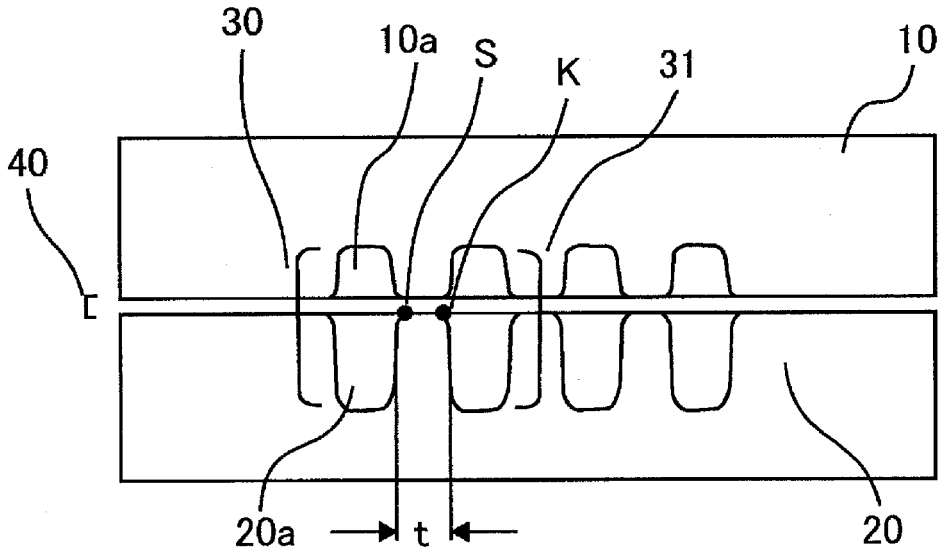
FIG. 8 is a view for explaining the structure of a waveguide structure according to Embodiment 3.

FIG. 8 is a cross-sectional view for explaining the structure of a waveguide structure according to Embodiment 3.

As illustrated in FIG. 8, a waveguide structure according to Embodiment 3 is configured in such a way that there is arranged a plurality of waveguide tubes that are formed with a tube wall having a thickness of a quarter of the free-space propagation wavelength at the frequency to be utilized.

In Embodiment 1 described above, there has been explained a case where there exists an ideal division plane with which the leakage of an electromagnetic wave hardly occurs.

However, in a waveguide tube in which the division plane is perpendicular to the tube axis of the waveguide, no ideal division plane exists. Accordingly, a case where no ideal division plane exists will be explained below.

In Embodiment 3, waveguide tubes are arranged in such way that the thickness "t" of the tube wall between adjacent waveguide tubes (e.g., waveguide tubes 30 and 31) becomes a quarter of the free-space propagation wavelength.

As illustrated in FIG. 8, by arranging waveguide tubes to be adjacent and parallel to one another in the tube axis direction and making the thickness "t" of the tube wall to be a quarter of the free-space propagation wavelength, the side-end portion S of the waveguide tube 30 becomes a short-circuit point, and the side-end portion K of the waveguide tube 31, which is adjacent to the waveguide tube 30, becomes an open-circuit point (the impedance is maximal at this point).

Accordingly, the electromagnetic wave that leaks through a gap 40 in the tube-wall portion and enters the adjacent waveguide tube can be suppressed to be minimal.

As illustrated in FIG. 8, by arranging a plurality of waveguide tubes to be adjacent and parallel to one another in the tube axis direction and making the thickness "t" of the tube wall to be a quarter of the free-space propagation wavelength, deterioration in the performance due to the leakage of an electromagnetic wave through an adjacent waveguide tube is suppressed to be minimal; therefore, not only excellent individual performances of waveguide tubes can be obtained, but also there can be obtained a waveguide structure in which isolation performances between the waveguide tubes are excellent.

Embodiment 4

Figure 9:
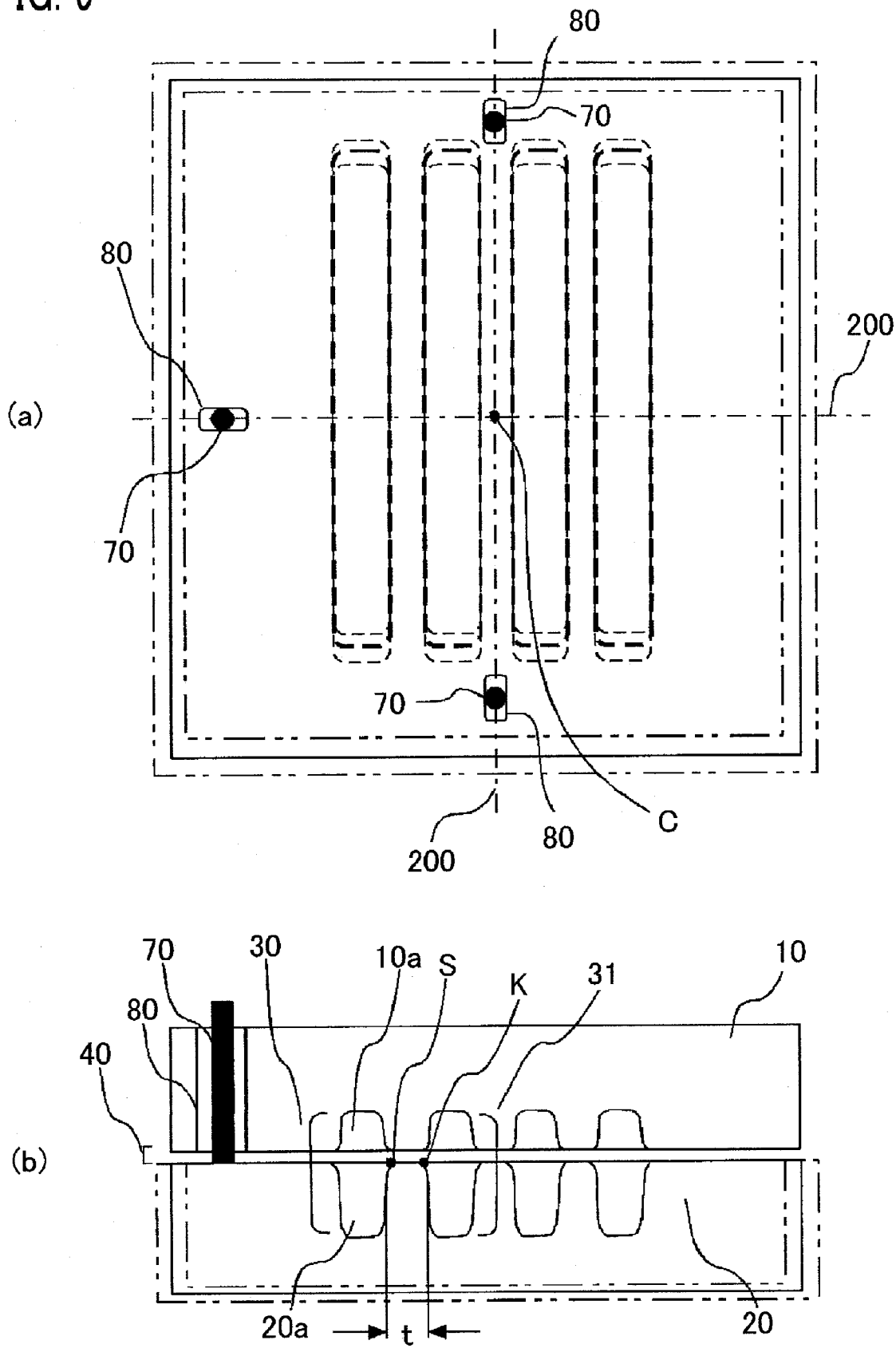
FIG. 9 is a set of views for explaining the structure of a waveguide structure according to Embodiment 4, where FIG. 9(*a*) is a top view and FIG. 9(*b*) is a cross-sectional view.

FIG. 9 is a set of views for explaining a waveguide structure according to Embodiment 4; FIG. 9(*a*) is a top view; FIG. 9(*b*) is a cross-sectional view.

As illustrated in FIG. 9(*a*), a waveguide tube according to Embodiment 4 is configured in such a way that positioning pins 70 are provided at three positions on axes 200 that are perpendicular to each other and pass through the center of one member (e.g., a second member 20 made of resin) out of two members that are made of different materials, and elongate holes 80 corresponding to the positioning pins 70 are provided in the other member (e.g., a first member 10 made of metal).

In such a way as described above, the positioning can be performed in such a way that a groove 10*a* formed in the surface portion of the member 10 and a groove 20*a* formed in the surface portion of the member 20 accurately face each other in the longitudinal direction (the tube axis direction shown in FIG. 9(*b*)) thereof and in a direction perpendicular to the longitudinal direction.

As explained in Embodiment 1, in the case where members having different linear-expansion coefficients are laminated, the amounts of expansion/contraction, due to change in temperature, of the members differ from each other.

FIG. 9 illustrates a positioning structure, in a waveguide structure where the members whose amounts of expansion/contraction are different from each other, for suppressing the occurrence of positional displacement due to change in temperature.

A center point "C", of the member in FIG. 9(*a*), is a point at which electromagnetic fields mostly converges and has a highest effect on the performance.

Accordingly, in the positioning structure, the members are fixed at the center point C as a reference point.

In FIG. 9(*a*), the positioning pins 70 are provided in the resin member (the second member) 20, and the elongate holes 80 into which the positioning pins 70 are inserted are provided in the metal member (the first member) 10; however, the relationship between the member in which the positioning pins 70 are provided and the member in which the elongate holes 80 are provided may be reversed.

The positioning pin 70 may be molded integrally with the resin member 20, or only the positioning member 70 may be formed of a different material.

Moreover, a structure that functions as the positioning pin 70 may be added to the protrusion position described in Embodiment 2.

Still moreover, a positioning structure may be added to the spacer 102 explained in Embodiment 2.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A waveguide structure comprising:

a first member made of metal, and including a first groove having a linear shape formed in a surface portion thereof; and a second member made of resin and plated with metal, the second member including a second groove having a linear shape formed in a surface portion thereof, the first member and the second member being arranged in such a way that the first groove and the second groove face each other so that a waveguide tube is configured, wherein the first member in the surface portion of which the first groove is formed and the second member in the surface portion of which the second groove is formed are held in such a way that a gap exists between the respective surfaces thereof.

2. The waveguide structure according to claim 1, wherein the first groove has a depth that is shallower than a depth of the second groove.

3. The waveguide structure according to claim 2, wherein the gap is formed by means of a protrusion portion provided in at least one of the first and second members.

4. The waveguide structure according to claim 3, wherein the waveguide includes additional waveguide tubes such that the waveguide tube and the additional waveguide tubes form a plurality of waveguide tubes, wherein a thickness of a tube wall between adjacent waveguide tubes is a quarter of a free-space propagation wavelength, and wherein the plurality of waveguide tubes are arranged in parallel with one another.

5. The waveguide structure according to claim 3, wherein, in one of the first and second members, positioning pins are provided at three positions on axes that are perpendicular to each other and pass through the center of the one member, and elongate holes into which the positioning pins are inserted are provided in the other member.

6. The waveguide structure according to claim 3, wherein no metal plating is applied to a portion, of the second member, on which the protrusion portion and the second member make contact with each other.

7. The waveguide structure according to claim 6, wherein the waveguide includes additional waveguide tubes such that the waveguide tube and the additional waveguide tubes form a plurality of waveguide tubes, wherein a thickness of a tube wall between adjacent waveguide tubes is a quarter of a free-space propagation wavelength, and wherein the plurality of waveguide tubes are arranged in parallel with one another.

8. The waveguide structure according to claim 6, wherein, in one of the first and second members, positioning pins are provided at three positions on axes that are perpendicular to each other and pass through the center of the one member, and elongate holes into which the positioning pins are inserted are provided in the other member.

9. The waveguide structure according to claim 2, wherein, in one of the first and second members, positioning pins are provided at three positions on axes that are perpendicular to each other and pass through the center of the one member, and elongate holes into which the positioning pins are inserted are provided in the other member.

10. The waveguide structure according to claim 2, wherein the waveguide includes additional waveguide tubes such that the waveguide tube and the additional waveguide tubes form a plurality of waveguide tubes, wherein a thickness of a tube wall between adjacent waveguide tubes is a quarter of a free-space propagation wavelength, and wherein the plurality of waveguide tubes are arranged in parallel with one another.

11. The waveguide structure according to claim 2, wherein the gap is formed by means of a spacer inserted between the first and second members, and no metal plating is applied to the portion, of the second member, on which the second member and the spacer make contact with each other.

12. The waveguide structure according to claim 11, wherein, in one of the first and second members, positioning pins are provided at three positions on axes that are perpendicular to each other and pass through the center of the one member, and elongate holes into which the positioning pins are inserted are provided in the other member.

13. The waveguide structure according to claim 11, wherein the waveguide includes additional waveguide tubes such that the waveguide tube and the additional waveguide tubes form a plurality of waveguide tubes, wherein a thickness of a tube wall between adjacent waveguide tubes is a quarter of a free-space propagation wavelength, and wherein the plurality of waveguide tubes are arranged in parallel with one another.

14. The waveguide structure according to claim 1, wherein the gap is formed by means of a spacer inserted between the first and second members, and no metal plating is applied to the portion, of the second member, on which the second member and the spacer make contact with each other.

15. The waveguide structure according to claim 14, wherein the waveguide includes additional waveguide tubes such that the waveguide tube and the additional waveguide tubes form a plurality of waveguide tubes, wherein a thickness of a tube wall between adjacent waveguide tubes is a quarter of a free-space propagation wavelength, and wherein the plurality of waveguide tubes are arranged in parallel with one another.

16. The waveguide structure according to claim 14, wherein, in one of the first and second members, positioning pins are provided at three positions on axes that are perpendicular to each other and pass through the center of the one member, and elongate holes into which the positioning pins are inserted are provided in the other member.

17. The waveguide structure according to claim 1, wherein, in one of the first and second members, positioning pins are provided at three positions on axes that are perpendicular to each other and pass through the center of the one member, and elongate holes into which the positioning pins are inserted are provided in the other member.

18. The waveguide structure according to claim 1, wherein the gap is formed by means of a protrusion portion provided in at least one of the first and second members.

19. The waveguide structure according to claim 18, wherein, in one of the first and second members, positioning pins are provided at three positions on axes that are perpendicular to each other and pass through the center of the one member, and elongate holes into which the positioning pins are inserted are provided in the other member.

20. The waveguide structure according to claim 18, wherein no metal plating is applied to a portion, of the second member, on which the protrusion portion and the second member make contact with each other.

21. The waveguide structure according to claim 20, wherein, in one of the first and second members, positioning pins are provided at three positions on axes that are perpendicular to each other and pass through the center of the one member, and elongate holes into which the positioning pins are inserted are provided in the other member.

22. The waveguide structure according to claim 20, wherein the waveguide includes additional waveguide tubes such that the waveguide tube and the additional waveguide tubes form a plurality of waveguide tubes, wherein a thickness of a tube wall between adjacent waveguide tubes is a quarter of a free-space propagation wavelength, and wherein the plurality of waveguide tubes are arranged in parallel with one another.

23. The waveguide structure according to claim 18, wherein the waveguide includes additional waveguide tubes such that the waveguide tube and the additional waveguide tubes form a plurality of waveguide tubes, wherein a thickness of a tube wall between adjacent waveguide tubes is a quarter of a free-space propagation wavelength, and wherein the plurality of waveguide tubes are arranged in parallel with one another.

24. The waveguide structure according to claim 1, wherein the waveguide includes additional waveguide tubes such that the waveguide tube and the additional waveguide tubes form a plurality of waveguide tubes, wherein a thickness of a tube wall between adjacent waveguide tubes is a quarter of a free-space propagation wavelength, and wherein the plurality of waveguide tubes are arranged in parallel with one another.

25. The waveguide structure according to claim 24, wherein, in one of the first and second members, positioning pins are provided at three positions on axes that are perpendicular to each other and pass through the center of the one member, and elongate holes into which the positioning pins are inserted are provided in the other member.

* * * * *